US008690522B2

(12) United States Patent
Nikpour

(10) Patent No.: US 8,690,522 B2
(45) Date of Patent: Apr. 8, 2014

(54) MULTISTAGE COMPRESSOR WITH IMPROVED MAP WIDTH PERFORMANCE

(71) Applicant: Cummins Turbo Technologies Limited, Huddersfield (GB)

(72) Inventor: Bahram Nikpour, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 13/744,575

(22) Filed: Jan. 18, 2013

(65) Prior Publication Data

US 2013/0142621 A1 Jun. 6, 2013

Related U.S. Application Data

(63) Continuation of application No. 12/732,757, filed on Mar. 26, 2010, now Pat. No. 8,414,249, which is a continuation of application No. PCT/GB2008/003222, filed on Sep. 24, 2008.

(30) Foreign Application Priority Data

Sep. 27, 2007 (GB) ..... 0718846.9

(51) Int. Cl.
*F04D 29/42* (2006.01)

(52) U.S. Cl.
USPC ..... 415/57.1; 415/57.2; 415/58.1; 415/58.2; 415/58.3; 415/58.4; 415/58.5; 415/59.1; 415/143; 415/199.6; 415/216.1; 415/914; 416/175; 416/244 A; 416/198 A; 416/201 R

(58) Field of Classification Search
USPC ..... 415/1, 57.1–57.2, 57.4, 58.1–58.5, 415/59.1, 143, 199.6, 914, 199.4, 216.1; 416/175, 183, 203, 244 R, 244 A, 244 B, 416/245 R, 245 A, 198 R, 198 A, 200 R, 416/200 A, 201 R, 201 A; 417/407
See application file for complete search history.

(56) References Cited

U.S. PATENT DOCUMENTS 2,962,206 A * 11/1960 Borden et al. ..... 415/143
3,904,308 A * 9/1975 Ribaud ..... 415/143

(Continued)

FOREIGN PATENT DOCUMENTS

EP 0229519 7/1987
EP 1473463 11/2004

(Continued)

OTHER PUBLICATIONS

United Kingdom Search Report, GB0718846.9, Cummins Turbo Technologies Limited, Jan. 19, 2008.
International Search Report, PCT/GB2008/003222, Cummins Turbo Technologies Limited, Mar. 9, 2009.
Written Opinion, PCT/GB2008/003222, Cummins Turbo Technologies Limited, International Searching Authority/European Patent Office, Mar. 27, 2010.
International Preliminary Report on Patentability, PCT/GB2008/003222 Cummins Turbo Technologies Limited, The International Bureau of WIPO, Mar. 30, 2010.

*Primary Examiner* — Christopher Verdier
(74) *Attorney, Agent, or Firm* — Krieg DeVault LLP; Clifford W. Browning

(57) ABSTRACT

A compressor typically for use in a turbocharger comprises a downstream radial compressor impeller wheel, an upstream axial compressor impeller wheel and an intermediate stator. The compressor housing has an inlet with inner and outer walls that define between them an MWE gas flow passage. An upstream opening defined by the flow passage provides communication between the passage and the intake and at least one first slot downstream of the upstream opening provides communication between the passage and the inner surface of the inner wall. The stator comprises a plurality of fixed vanes and is disposed in the inner wall of the inlet between the radial and axial impeller wheels. The position of the slot can be at one of several positions along the gas flow passage, hi other embodiments there are second and third slots and the flow passage is divided into two parts. All the arrangements are designed to improve the compressor map width.

2 Claims, 8 Drawing Sheets

(56) References Cited

U.S. PATENT DOCUMENTS

| | | | | |
|---|---|---|---|---|
| 4,637,779 | A | 1/1987 | Sherman et al. | |
| 4,728,256 | A * | 3/1988 | Araoka | 415/121.2 |
| 4,743,161 | A | 5/1988 | Fisher et al. | |
| 4,781,530 | A | 11/1988 | Lauterbach et al. | |
| 4,830,584 | A | 5/1989 | Mohn | |
| 4,930,979 | A | 6/1990 | Fisher et al. | |
| 5,246,335 | A | 9/1993 | Mitsubori et al. | |
| 6,378,307 | B1 | 4/2002 | Fledersbacher et al. | |
| 6,447,241 | B2 | 9/2002 | Nakao | |
| 6,634,174 | B2 | 10/2003 | Sumser et al. | |
| 6,648,594 | B1 | 11/2003 | Horner et al. | |
| 2002/0012586 | A1 | 1/2002 | Nikpour | |
| 2004/0175265 | A1 | 9/2004 | Wagner | |
| 2005/0002782 | A1 * | 1/2005 | Nikpour et al. | 415/208.1 |
| 2005/0008484 | A1 | 1/2005 | Nikpour et al. | |
| 2007/0204615 | A1 | 9/2007 | Vrbas | |

FOREIGN PATENT DOCUMENTS

| | | |
|---|---|---|
| FR | 931344 | 10/1947 |
| FR | 1022629 | 12/1952 |
| GB | 1125251 | 1/1918 |
| GB | 611447 | 10/1948 |
| GB | 1373177 | 11/1974 |
| GB | 2127898 | 4/1984 |
| GB | 2202585 | 9/1988 |
| WO | WO 2008/107276 | 9/2008 |

* cited by examiner

MULTISTAGE COMPRESSOR WITH IMPROVED MAP WIDTH PERFORMANCE

CROSS REFERENCE TO RELATED APPLICATIONS

The present application is a continuation of U.S. patent application Ser. No. 12/732,757, filed Mar. 26, 2010, now U.S. Pat. No. 8,414,249, which is a continuation of PCT/GB2008/003222 filed Sep. 24, 2008, which claims priority upon United Kingdom Patent Application No. 0718846.9 filed Sep. 27, 2007, each of which are incorporated herein by reference.

The present invention relates to a compressor and more particularly to a multistage compressor suitable for use in a turbocharger.

A compressor comprises an impeller wheel, carrying a plurality of blades (or vanes) mounted on a shaft for rotation within a compressor housing. Rotation of the impeller wheel causes gas (e.g. air) to be drawn into the impeller wheel and delivered to an outlet chamber or passage. In the case of a radial or centrifugal compressor the outlet passage is in the form of a scroll volute defined by the compressor housing around the impeller wheel and in the case of an axial compressor the gas is discharged axially.

The turbocharger is a well-known device for supplying air to the intake of an internal combustion engine at pressures above atmospheric (boost pressures) and is widely used on automobiles and the like. The compressor of a turbocharger is driven by an exhaust gas turbine that is mounted on a common shaft. Exhaust gas from the internal combustion engine flows through the turbine and drives the turbine wheel in rotation, which, in turn, rotates the compressor impeller. Air is drawn through an axial inlet of the compressor housing and compressed air is delivered to the intake manifold of the internal combustion engine, thereby increasing engine power.

One aspect of turbocharger control is to ensure stable operation by avoiding what is known as surge. If the turbocharger is operating at a relatively low compressor volumetric air flow rate and a high boost pressure the air flow into the compressor may stall and the operation of the compressor is interrupted. Following stall, the air flow tends to reverse through the compressor until a stable pressure ratio is reached at which the air can flow in the correct direction. This process repeats and results in pulsations in the air flow known as surging. Maximum operating efficiency of the engine is achieved by operating close to the surge limit and a surge margin is built into the control process to ensure that the turbocharger operates at a safe distance from the surge condition.

In some turbochargers the compressor inlet has a structure that has become known as a "map width enhanced" (MWE) structure. An MWE structure is described for instance in U.S. Pat. No. 4,743,161. The inlet of such an MWE compressor comprises two coaxial tubular inlet sections, an outer inlet section or wall forming the compressor intake and inner inlet section or wall defining the compressor inducer, or main inlet. The inner inlet section is shorter than the outer inlet section and has an inner surface that is an extension of a surface of an inner wall of the compressor housing which is swept by edges of the impeller wheel blades. The arrangement is such that an annular flow path is defined between the two tubular inlet sections, the path being open at its upstream end and provided with apertures or a slot (hereinafter referred to as the "MWE slot") at its downstream end that communicate with the inner surface of the compressor housing that faces the impeller wheel. In operation, the MWE slot allows additional air to be drawn into the compressor under high flow (near choke) conditions, however its most important function is at lower flow rates and, in particular, as the compressor approaches surge. Under these conditions the MWE slot allows the flow to reverse (which is now the prevalent flow regime in parts of the compressor) and to be re-circulated to the intake, thus delaying surge.

The MWE structure stabilises the performance of the compressor increasing the maximum flow capacity and improving the surge margin, i.e. decreasing the flow at which the compressor surges, so that the range of engine r.p.m. over which the compressor can operate in a stable manner is increased. A given compressor can thus be matched to engines with a wider speed range. This is known as increasing the width of the compressor "map", which is a plot of the compressor characteristic.

It is one object of the present invention to provide for a compressor with an improved map width performance.

According to a first aspect of the present invention there is provided a compressor comprising:

- a housing defining a gas inlet and a gas outlet;
- a radial impeller wheel having a plurality of vanes and mounted in the housing between said inlet and outlet, the wheel being rotatable about an axis;
- the inlet comprising a substantially tubular outer wall extending away from the impeller wheel in an upstream direction and forming a gas intake, and a substantially tubular inner wall extending away from the impeller wheel in an upstream direction and within the outer wall, the inner wall defining an inner surface at least a portion of which is located in close proximity to radially outer edges of the radial impeller vanes which sweep across said surface as the impeller wheel rotates about its axis;
- a substantially annular gas flow passage defined between the inner and outer walls and extending from an upstream end to a downstream end proximate to the radial compressor impeller;
- the passage having an upstream opening providing communication between said passage and said intake;
- at least one aperture downstream of the upstream opening and providing communication between the passage and the inner surface of the inner wall;
- an axial impeller wheel supported for rotation in said inlet upstream of the radial impeller wheel; and
- a stator comprising a plurality of fixed vanes and disposed in the inlet between the radial and axial impeller wheels and within the inner wall.

The inner and outer walls of the inlet may be formed as integral or separate parts. The inner and outer walls may be substantially coaxial. The inner wall may be shorter in length than the outer wall.

The axial impeller wheel may be provided within the inner wall of the inlet.

The at least one first aperture may be provided in the inner wall of the inlet and it may be in the form of a slot that may be discontinuous and which may be substantially annular. The aperture may alternatively comprise one or more holes disposed at intervals around the inner wall.

The inner and outer walls and the flow passage may be substantially annular.

The at least one first aperture may be located over the vanes of the radial impeller. The vanes of the radial impeller each comprise a radially outer edge, the at least one aperture being adjacent to a radially outer edge. The vanes of the radial compressor may further comprise leading and trailing edges interconnected by said outer edges, the at least one aperture being provided adjacent to a junction between the outer edges and the leading edges of the vanes.

At least one second aperture and at least one third aperture may be provided in said inner wall at locations axially spaced from the at least one first aperture, said second aperture being disposed over the vanes of the stator and the third aperture being disposed over the vanes of the axial compressor. The vanes of the stator and the axial compressor may each comprise a radially outer edge, a leading edge and a trailing edge. The at least one second aperture may be disposed over said radially outer edge of the stator at any axial position. For example it may be at or adjacent to the leading edge of the vanes or at (or adjacent to) the trailing edge or somewhere in between. More precisely, the at least one second aperture may have an end that is coincident with, or is immediately adjacent to, a substantially radial plane that is normal to the axis and which intersects the vanes of the stator. The radial plane may intersect a junction between the leading edges and the outer edges of the vanes of the stator or may intersect a junction between the trailing edges and the outer edges of the vanes of the stator or may intersect the outer edges of the vanes of the stator at an axial location between the junction of the leading edges with the outer edges and the junction between the trailing edges and the outer edges, such as, for example, an axial location mid-way between the two junctions.

The vanes of the axial compressor impeller may each comprise a radially outer edge, a leading edge and a trailing edge, the at least one third aperture being disposed over said radially outer edge. The at least one third aperture may disposed adjacent to a leading edge of at least one vane of the axial compressor impeller.

The at least one third aperture has an end that is coincident with, or is immediately adjacent to, a substantially radial plane that is normal to the axis and which intersects the vanes of the axial compressor impeller. The radial plane may intersect a junction between the leading edges and the outer edges of the vanes of the axial compressor impeller, or a junction between the trailing edges and the outer edges of the vanes of the axial compressor impeller, or the outer edges of the vanes of the axial compressor at an axial location between the junction of the leading edges with the outer edges and the junction between the trailing edges and the outer edges such as, for example, an axial location mid-way between the two junctions.

There may be provided a dividing wall in said gas flow passage, dividing the passage into two portions and the dividing wall may be disposed between the at least one first aperture and the at least one second aperture.

The dividing wall may be movable in an axial direction in the gas flow passage so as to adjust the relative volumes of the first and second portions of the passage.

The at least one first aperture may be located over the vanes of the stator. The vanes of the stator may each comprise a radially outer edge, a leading edge and a trailing edge, the at least one first aperture being disposed over said radially outer edge. The at least one first aperture may be disposed adjacent to leading edges of the vanes of the stator. More specifically the at least one first aperture may have an end that is coincident with, or is immediately adjacent to, a substantially radial plane that is normal to the axis and which intersects the vanes of the stator. The radial plane may intersects a junction between the leading edges and the outer edges of the vanes of the stator, a junction between the trailing edges and the outer edges of the vanes of the stator, or the outer edges of the vanes of the stator at an axial location between the junction of the leading edges with the outer edges and the junction between the trailing edges and the outer edges such as for example an axial location mid-way between the two junctions.

Alternatively, the at least one first aperture may be located over the vanes of the axial compressor impeller which may each comprise a radially outer edge, a leading edge and a trailing edge. The at least one first aperture may be disposed over said radially outer edge and may be adjacent to a leading edge the vanes of the axial compressor impeller.

The at least one first aperture may have an end that is coincident with, or is immediately adjacent to, a substantially radial plane that is normal to the axis and which intersects the vanes of the axial compressor impeller. The radial plane may intersect a junction between the leading edges and the outer edges of the vanes of the axial compressor impeller, or a junction between the trailing edges and the outer edges of the vanes of the axial compressor impeller, or the outer edges of the vanes of the axial compressor at an axial location between the junction of the leading edges with the outer edges and the junction between the trailing edges and the outer edges such as, for example, an axial location mid-way between the two junctions.

The vanes of the axial and radial compressor impellers preferably each extend outwardly from a respective hub. A radial distance between the axis and an outer surface of the hub of the axial compressor may be greater than that from the axis to the outer surface of the hub of the radial compressor impeller. The radial distance from the axis to the outer surface of the hub of the radial compressor may be less than 85% of the radial distance from the axis to the outer surface of the hub of the axial compressor and more preferably less than 60% of the radial distance from the axis to the outer surface of the hub of the axial compressor.

The hub of the axial impeller may be convex for at least part of its outer surface.

The hub of the axial compressor impeller may have an internal thread so as to serve as a nut for mounting on the end of the shaft.

The stator may comprise inner and outer walls and the inner wall of the stator may extend substantially between the hubs of the radial and axial impeller wheels. The inner wall may be tapered or may have a taper defined on its inner surface. The outer wall may have a taper which may be defined on an inner surface of the outer wall. The taper of the inner wall may be steeper than that of the outer wall.

An outer surface of the inner wall of the stator may have an upstream convex portion and a downstream concave portion.

The compressor housing may comprise a plurality of parts. For example the housing may comprise a main body with an integral or separable inlet portion. The main body may define the outlet and house the radial compressor impeller wheel. The inlet itself may have separate inner and outer walls or they may be integrally connected. The inlet may comprise an outer wall integral with or connected to the main body and an insert in the outer wall that defines at least part of the inner wall.

The inner surface of the inner wall may be partly defined by an inner surface on the main body of the housing.

The upstream opening defined by the flow passage may be substantially annular.

The at least one first aperture may be a substantially annular first slot, which may be discontinuous. Similarly the at least one second and third apertures may each be in the form of a substantially annular slot. Alternatively, each of the apertures may be in the form of one or more holes arranged around the inner wall of the inlet.

The vanes of the axial and radial compressor impellers may extend from a respective hub. A radial distance between the axis and an outer surface of the hub of the axial compressor may be greater than that from the axis to the outer surface of the hub of the radial compressor impeller.

The stator may comprise inner and outer walls. The inner wall may extend between the hubs of the radial and axial impeller wheels. The inner wall or the outer surface thereof may be tapered.

The hub of the axial impeller may be convex for at least part of its outer surface at least in the area between the leading and trailing edges of vanes.

The outer surface of the inner wall of the stator may have an upstream convex portion and a downstream concave portion.

The radial distance from the axis to the base of the vanes adjacent to the hub of the radial compressor is preferably less than 85% of the radial distance from the axis to the base of the axial compressor vanes; and more preferably less than 60%.

The hub of the axial compressor impeller preferably has an internal thread so as to serve as a nut for mounting on the end of the shaft.

According to a second aspect of the present invention there is provided a turbocharger comprising a compressor as defined above and a turbine that drives said impeller wheels in rotation.

According to a third aspect of the present invention there is provided an internal combustion engine fitted with a turbocharger as defined above.

According to a fourth aspect of the present invention there is provided a method for operating a compressor in a turbocharger, comprising: rotating a radial impeller wheel in a housing so as compress a gas drawn into the housing from an inlet and to deliver it to an outlet in the housing, the inlet comprising inner and outer substantially tubular walls extending away from the impeller wheel in an upstream direction and forming a gas intake, and a substantially tubular gas flow passage defined between the inner and outer walls and extending from an opening at an upstream end to a downstream end proximate to the radial impeller; operating the compressor near surge conditions such that gas is recirculated from inside the inner wall through at least one first aperture in the inner wall and into the gas flow passage, rotating an axial compressor impeller wheel in said inlet upstream of the radial impeller wheel in order to compress incoming gas and delivering the gas to a vaned stator intermediate the axial and radial compressor impellers, wherein the recirculating gas flows in the passage from the at least one first aperture to at least one axially spaced second aperture in the inner wall through which it then passes to the inner wall along which it flows axially upstream to at least one third aperture in the inner wall, the gas passing through the at least one third aperture so that it re-emerges in the gas flow passage for delivery to the opening.

According to a fifth aspect of the present invention there is provided a compressor comprising:

a housing defining a gas inlet and a gas outlet;

a radial impeller wheel having a plurality of vanes and mounted in the housing between said inlet and outlet, the wheel being rotatable about an axis;

the inlet comprising a substantially tubular wall extending away from the impeller wheel in an upstream direction and forming a gas intake, the inlet wall defining an inner surface at least a portion of which is located in close proximity to radially outer edges of the vanes of the radial impeller which sweep across said surface as the radial impeller wheel rotates about its axis;

an axial impeller wheel having a plurality of vanes and supported for rotation in said inlet upstream of the radial impeller wheel; and a stator comprising a plurality of fixed vanes and disposed in the inlet between the radial and axial impeller wheels;

wherein the vanes of the axial and radial compressor impellers each extend outwardly from a respective hub and the radial distance between the axis and an outer surface of the hub of the axial compressor is greater than that from the axis to the outer surface of the hub of the radial compressor impeller. The inlet may have inner and outer walls as defined above.

According to a sixth aspect of the present invention there is provided a compressor comprising:

a housing defining a gas inlet and a gas outlet;

a radial impeller wheel having a plurality of vanes and mounted in the housing between said inlet and outlet, the wheel being rotatable about an axis;

the inlet comprising a substantially tubular wall extending away from the impeller wheel in an upstream direction and forming a gas intake, the inlet wall defining an inner surface at least a portion of which is located in close proximity to radially outer edges of the vanes of the radial impeller which sweep across said surface as the radial impeller wheel rotates about its axis;

an axial impeller wheel having a plurality of vanes and supported for rotation in said inlet upstream of the radial impeller wheel;

the axial and radial impeller wheels being mounted on a common shaft, the axial impeller wheel having an internal thread for connection to a corresponding thread on the shaft so as to retain the radial compressor impeller wheel in place.

The thread may be defined on an internal surface of a hub of the axial compressor impeller, the vanes extending from the hub.

An axial stator with fixed vanes may be provided between the axial and radial compressor impeller wheels, the threaded axial impeller also serving to retain the stator in place.

Specific embodiments of the present invention will now be described, by way of example only, with reference to the accompanying drawings, in which.

Figure 5:
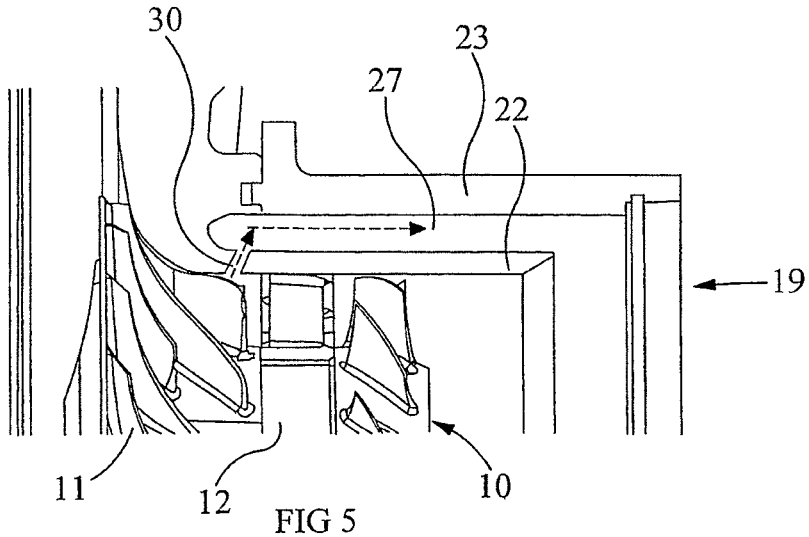
FIG. 5 is a sectioned side view of part of the compressor of FIG. 2 showing air flow in the MWE passage at surge, only that half of the compressor that is above the centre axis is shown.
Figure 12:
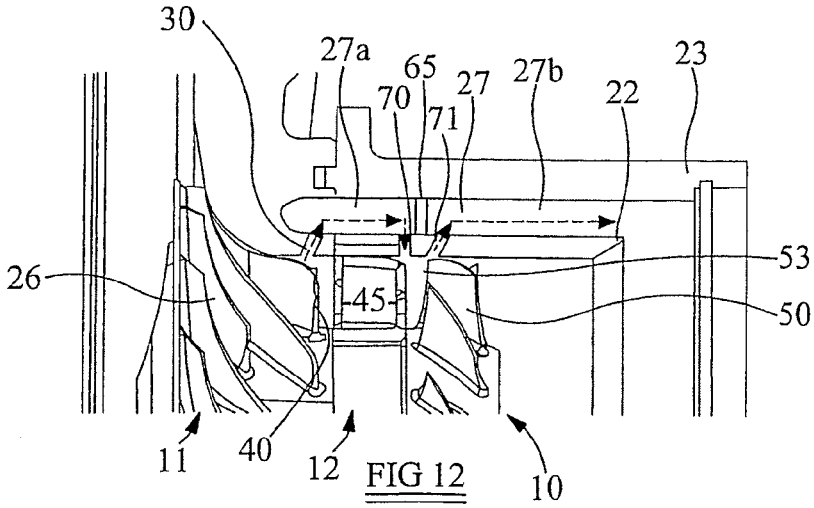
Figure 13:
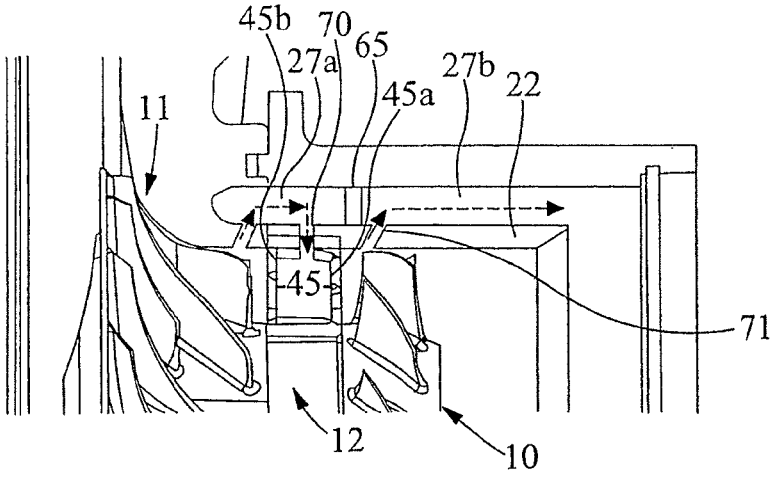
Figure 14:
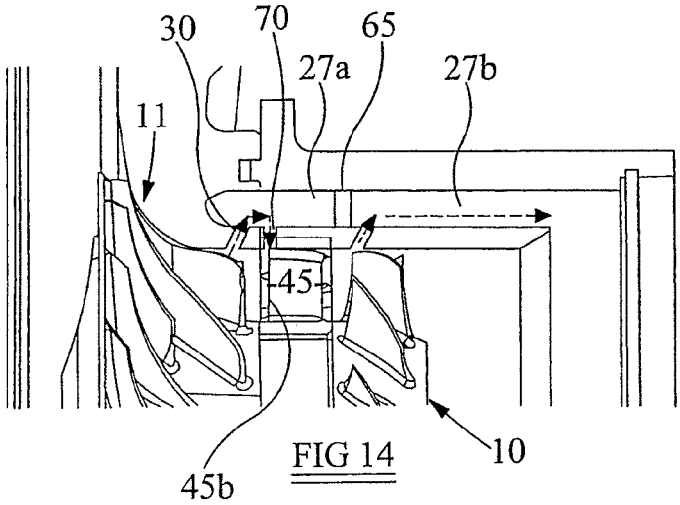
Figure 15:
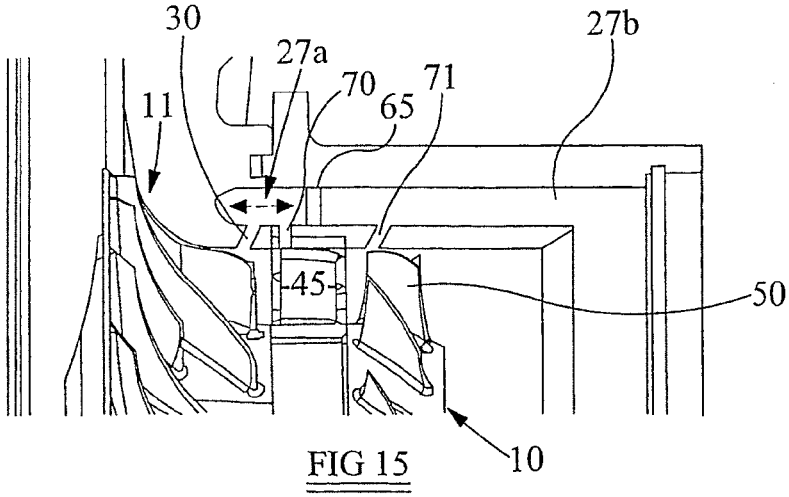

FIGS. 6 to 11 correspond to the view of FIG. 5 but shows alternative positions of the slot in the MWE passage;

FIG. 12 corresponds to the view of FIG. 5 but shows an alternative configuration of the MWE passage in which there are three slots and a separating wall; and FIGS. 13-15 show compressor arrangements that are similar to that of FIG. 12 but with the position of the slots arranged in alternative configurations.

Figure 1:
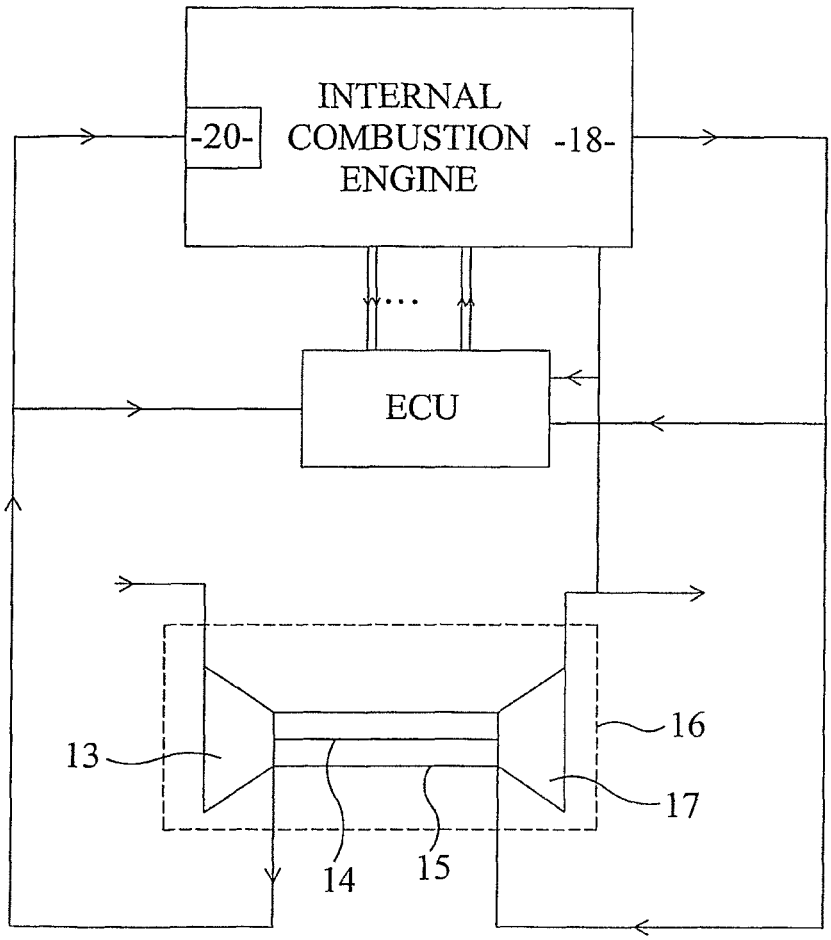
FIG. 1 is a diagrammatic representation of a turbocharger having a compressor in accordance with the present invention and fitted to an internal combustion engine.
Figure 2:
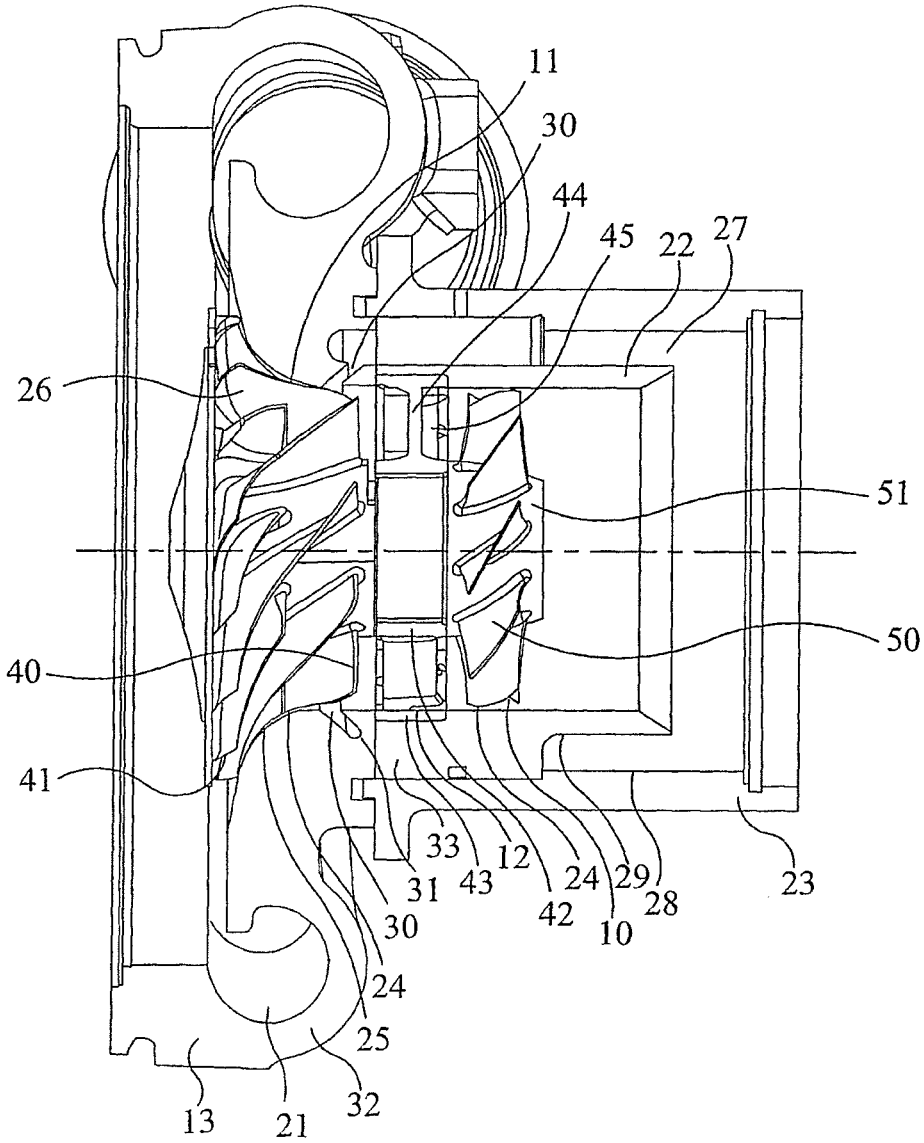
FIG. 2 is a part-sectioned side view of a first embodiment of a compressor in accordance with the present invention.
Figure 3:
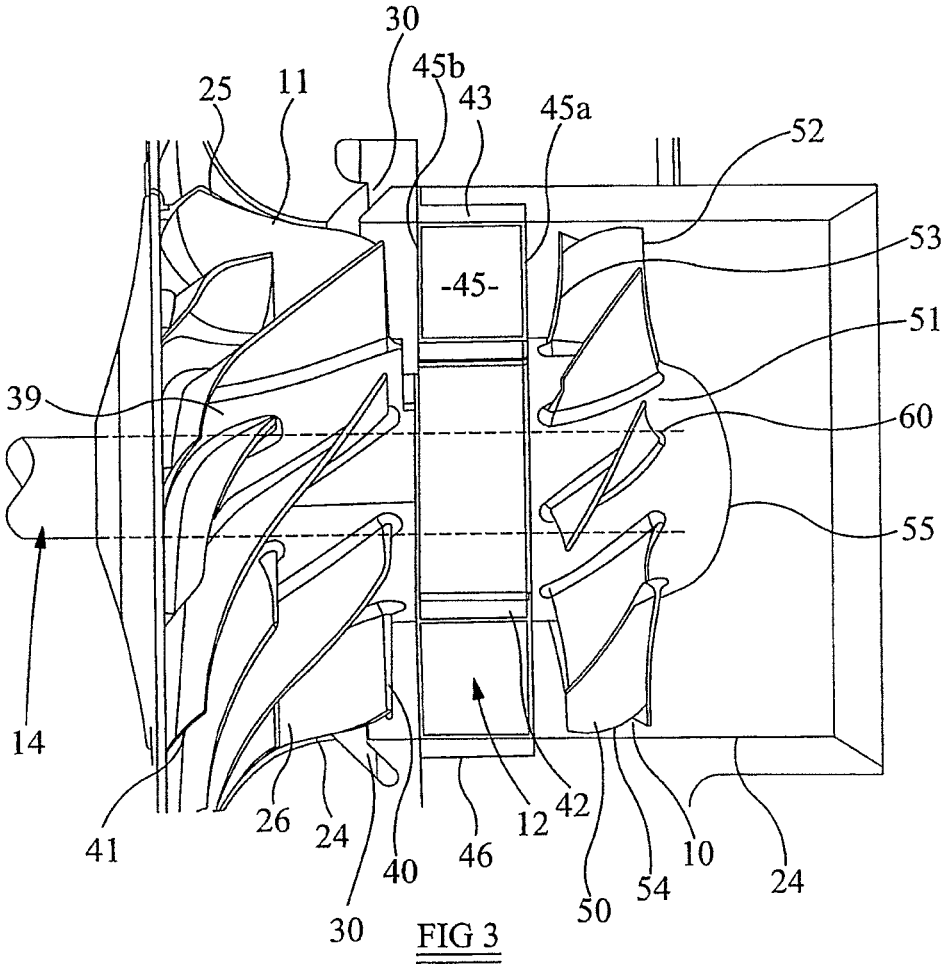
FIG. 3 is an enlarged view of part of the compressor of FIG. 2 with a shaft of the turbocharger shown.

FIG. 1 shows a compressor of the present invention in the context of a turbocharger fitted to an internal combustion engine. A detailed exemplary embodiment of the compressor detail is shown in FIGS. 2 and 3. The illustrated compressor is a two-stage compressor for achieving high compression ratios and comprises an axial compressor impeller 10 located upstream of a radial (centrifugal) compressor impeller 11 and spaced therefrom by an intermediate axial stator 12. The impeller wheels 10, 11 are mounted within a compressor housing 13 on a common rotary shaft 14 (shown in FIG. 3 only) that rotates about a compressor axis represented by the chain dotted line in FIG. 2.

The compressor housing 13 is connected to the bearing housing 15 of a turbocharger 16 and the shaft 14 is designed to support an exhaust gas turbine wheel 17 disposed on the other side of the bearing housing 15. In operation, exhaust gas from an internal combustion engine 18 flows through the turbine 17 and drives the turbine wheel in rotation, which, in turn, rotates the compressor impellers 10, 11. Air is drawn through an axial inlet 19 of the compressor housing 13 and compressed air is delivered to the intake manifold 20 of the internal combustion engine, thereby increasing engine power. The compressor housing 13 defines an outlet scroll volute 21 surrounding the radial impeller wheel 11. The turbocharger is operated under the control of the ECU of the internal combustion engine 18.

The inlet 19 is defined by concentric inner and outer walls 22, 23 that extend coaxially with the compressor axis away from the radial impeller wheel 11. The inner wall 22 is substantially cylindrical and defines a gas inducer part of the inlet 19. An inner surface 24 of the wall 22 extends from a downstream end, where outer edges 25 of the impeller wheel vanes 26 sweep in close proximity thereto, to an upstream end distal from the radial impeller wheel 11. The outer wall 23 is similarly substantially cylindrical and defines an intake portion of the inlet. It extends beyond the inner wall 22 at the upstream end and defines an annular gas flow passage 27 between its inner surface 28 and the outer surface 29 of the inner wall 22.

The annular gas flow passage 27 is open at the upstream end and closed at the downstream end save for a discontinuous annular slot 30 through the inner wall 22 that provides air (or other gas) communication between the radial impeller wheel 11 and interior of the passage 27. The slot 30 is made discontinuous by a plurality of webs 31 (one only shown in FIG. 2) that bridge the slot 30 at intervals around its circumference.

In the embodiment of FIGS. 2 and 3, the compressor housing 13 has an inlet structure 19 comprising separate components. In particular the outer wall 23 and a major portion of the inner wall 22 are separate components with the outer wall 23 being releasably connected to the main body 32 of the housing 13 by any suitable connection arrangement and the inner wall 23 being an insert that is received in the outer wall and supported by one or more substantially radial struts 33. One example connection is a V-band or the like that passes around the join between the outer wall 23 and a part of the main body 32 to retain them together. In an alternative arrangement the inlet 19 may be a single part that is releasably connectable to the main body 32 of the housing 13. In a further alternative, the housing is a unitary structure and in a yet further alternative the main body 32 and the outer wall 23 of the inlet 19 are integrally formed with a separate insert being provided for the inner wall 22 of the inlet.

As can be seen from the embodiment of FIGS. 2 and 3 the inner wall may be partly defined by the insert and partly by the main body of the housing 13.

The radial impeller wheel 11 has a plurality of vanes 26 of conventional design extending from a hub 39 and each including a leading edge 40, a trailing edge 41 and an outer edge 25 that sweep over the inner surface 24 defined by the downstream portion of the inner wall 22. The vanes 26 are configured to change the direction of the incoming air from a substantially axial flow direction to a substantially radial flow direction towards the outlet volute 21.

The stator 12 comprises inner and outer annular walls 42, 43 that are interconnected at intervals by radially extending struts 44. The walls 42, 43 define between them a flow path and support a plurality of circumferentially spaced vanes 45 having surfaces that extend in a generally axial direction from a leading edge 45*a* to a trailing edge 45*b* and for directing the air flow along the path from the axial impeller 10 to the radial impeller wheel 11. The inner surface 24 of the inner wall 22 of the inlet 19 has an annular recess 46 for receipt of the outer wall 43 of the stator 12 such that it is held in the inlet 19 without contacting the shaft 14 or other compressor components.

The axial compressor impeller wheel 10 comprises a plurality of outwardly extending vanes 50 supported on a central hub 51 around the shaft 14, each vane having a leading edge 52, a trailing edge 53 and a radially outer edge 54 that sweeps over the inner surface 24 of the inner wall 23. The vanes 50 serve to impart an initial compression of the air but do not change the generally axial flow direction significantly and the compressed air is passed to the stator 12.

In general, the stator 12 is designed to match the axial compressor impeller 10 such that the flow exiting the stator 12 has minimal swirl. In order to avoid vibration induced fatigue in the radial compressor impeller 11 it is desirable that it has a different number of vanes compared to the stator 12. Similarly the number of vanes 45 on the stator 12 should be different to that of the axial compressor impeller 10 to avoid vibration in the stator 12.

In operation of the compressor, during high flow and high r.p.m., the pressure at the radial impeller 11 end of the slot 30 is less than that at the passage 27 end of the slot and air thus flows from the passage 27 through the slot 30 to the radial impeller wheel 11 thereby increasing the volume of air reaching the impeller 11 at near choke conditions. At lower flow rates and, in particular, as the compressor approaches surge the air flow in the annular passage 27 reverses and is recirculated to the intake (as illustrated by the dotted arrowed line in FIG. 5), thus delaying surge. The annular flow passage 27 (often referred to as a Map-Width Enhanced (MWE) structure) stabilises the performance of the compressor by increasing the maximum flow capacity and improving the surge margin, i.e. decreasing the flow at which the compressor surges, so that the range of engine r.p.m. over which the compressor can operate in a stable manner is increased.

The axial position of the annular slot 30 is disposed over the outer edge of the vanes 26 of the radial impeller 11 and, in the embodiment of FIGS. 2 and 3, is adjacent to the leading edge 40 of the vanes 26. However, it is to be understood that the exact axial position of the slot 30 may vary relative to the vanes 26.

In FIG. 3 the shaft 14 is represented in dotted line and an upstream facing surface 55 of the hub 51 of the axial impeller 11 is contoured in a convex shape for improved air flow.

Figure 4:
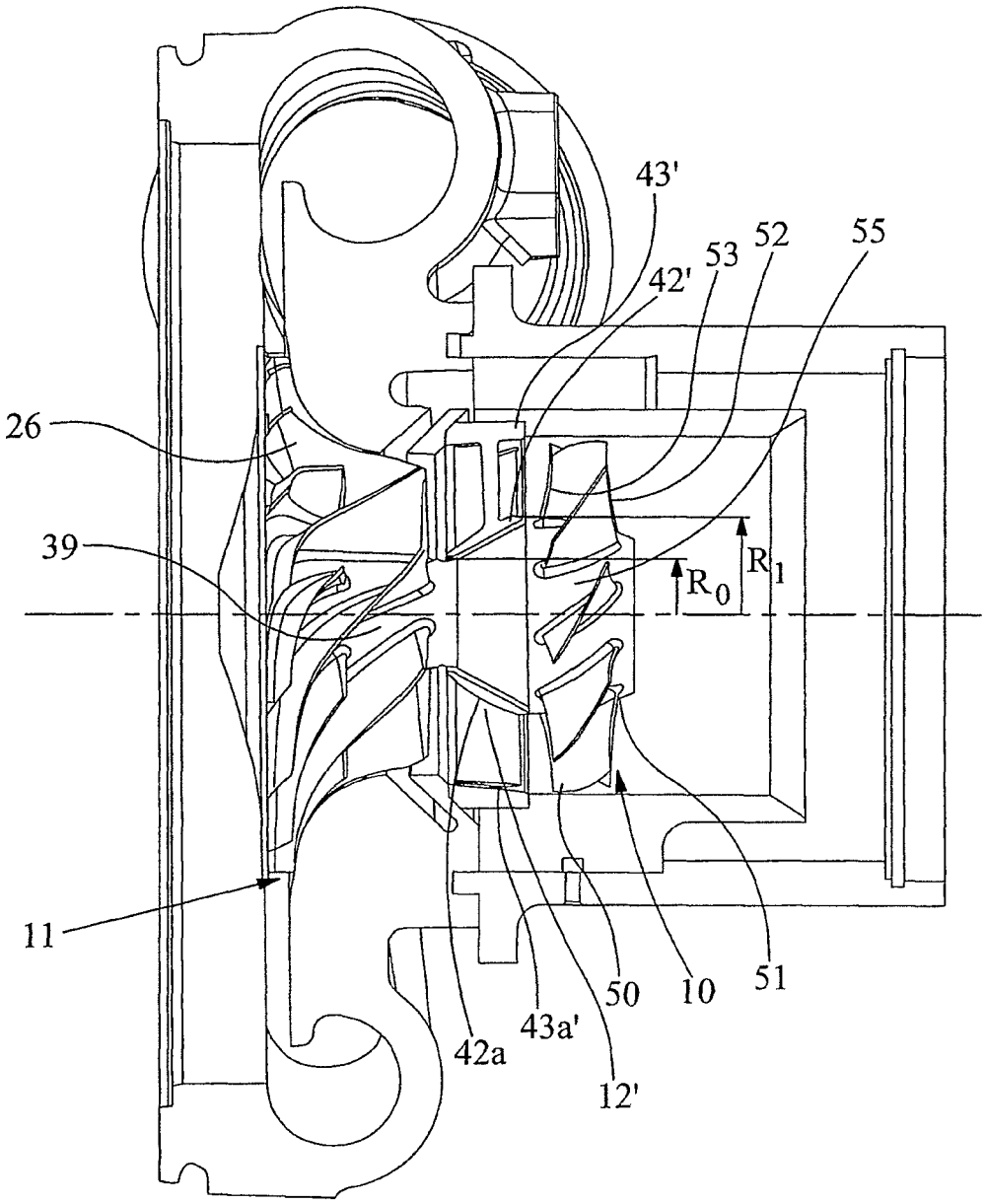
FIG. 4 is a part-sectioned side view of a second embodiment of a compressor, which has a different stator design.

FIG. 4 illustrates an alternative compressor embodiment in which the only change compared to the compressor of FIGS. 2 and 3 is the stator design. Parts corresponding to those of FIGS. 2 and 3 are given the same reference numerals for ease of reference and understanding. The radial position of the hub 51 of the axial compressor impeller 10 is at a greater distance from the axis compared to the radial position of the hub 39 of the radial compressor impeller 11. In order to accommodate this difference in the cross sectional area of the flow paths the stator flow path is configured to be divergent by virtue of tapers defined by the inner and outer walls 42', 43' of the stator 12'. The radially inwards facing surface 43*a*' of the outer wall 43' has a shallow taper whereas the radially outwards facing surface 42*a*' of the inner wall 42 has a more pronounced taper so as to provide gradual change in the cross sectional area of the flow path through the stator 12'. It will be seen that the outwards facing surface 42*a*' of the inner wall 42' extends from a radial position at one end that is substantially contiguous with the surface 55 of the hub 51 of the axial compressor impeller 10 to a position where it is substantially contiguous with the surface of the hub 39 of the radial compressor impeller 11.

The cross sectional flow area of the axial compressor 10 is thus smaller than that of the radial compressor impeller wheel 11 at a corresponding axial position between the leading and trailing edges 52, 53 and 40, 41 of the respective vanes 50, 26. The cross-sectional area of the flow through a given compressor impeller 10, 11 may be defined as that mid-way between the leading and trailing edges of the vanes of that impeller, or that at the trailing edge of the vanes, or as a further alternative that at the point where the diameter of the impeller hub is at its greatest.

If Ro is the radial distance from the compressor axis to the surface of the hub 39/base of the vanes 26 of the radial compressor 11 and $R_1$ is the radial distance from the axis to the hub of the axial compressor (see FIG. 4). The radial distance Ro of the radial compressor impeller 11 is preferably less than 85% of the equivalent radial distance $R_1$ of the axial compressor 10 and more preferably less than 60%.

The hub 51 of the axial compressor 10 may be convex in the region between the leading and trailing edges 52, 53 of the vanes 50 such that its greatest diameter is at a position between the leading and trailing edges. An upstream portion of the inner wall 42, 42' of the stator 12, 12' may also be convex and a downstream portion may be concave.

The hub 51 of the axial compressor impeller 10 may have an internal thread 60 by which it is fixed to the shaft 14 in the manner of a nut thus retaining the radial compressor impeller 11 and the stator 12 on the shaft as depicted in FIG. 3.

Figure 6:
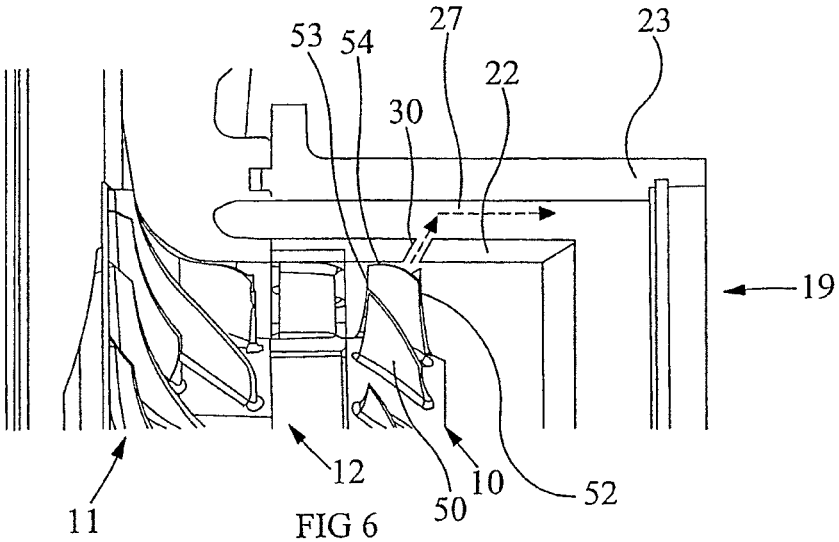
Figure 7:
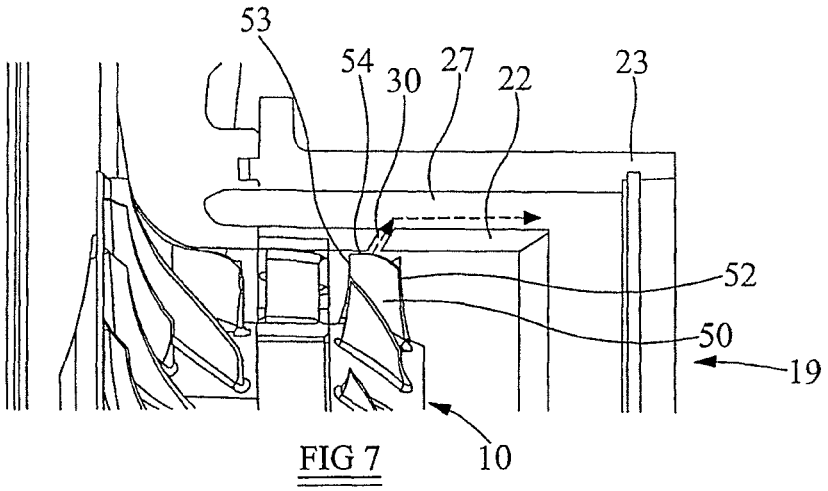
Figure 8:
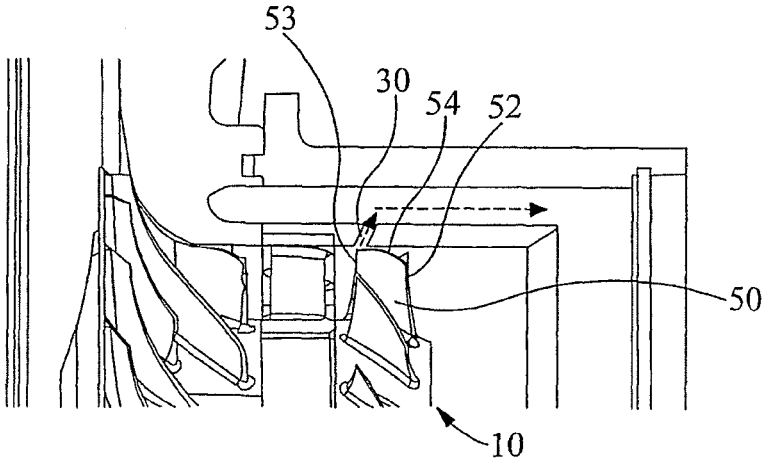

Referring now to FIGS. 6 to 11, there is shown a range of alternative annular flow path configurations of the compressor. In each illustrated embodiment the configuration of the impeller wheels 10, 11 and the stator 12 is the same but the axial position of the slot 30 in the inner wall 22 of the inlet 19 is different. For ease of reference and understanding the slot is designated with the same reference numeral (30) in each case. In the embodiment of FIG. 6 the slot 30 is disposed opposite to the outer edge 54 and at the leading edge 52 of the axial compressor impeller vanes 50, that is the central axis of the recirculating flow path (represented in dotted line) through the slot starts at, or is in close proximity to, a radial plane normal to the axis of rotation of the shaft 14 and which intersects the junctions between the leading edges 52 and the radial outer edges 54 of the vanes 50 of the axial impeller 10. The slot 30 may be positioned at any axial location between the leading and trailing edges 52, 53 of the vanes 50 of the axial compressor impeller 10. In the example of FIG. 7, it is shown at a position substantially mid-way between the junctions between the outer edges 54 and the leading and trailing edges 52, 53 respectively and in FIG. 8 the slot 30 starts at a location that is substantially coincident with a radial plane that extends through the junction between the trailing 53 and outer edges 54 of the vanes 50.

Figure 9:
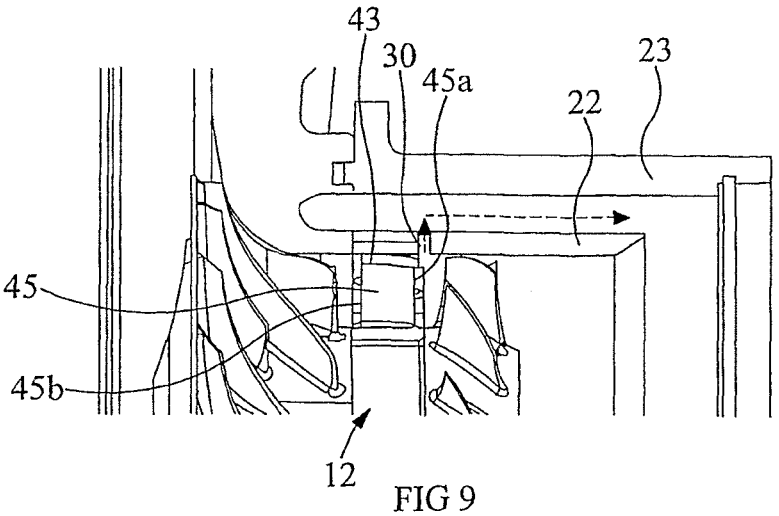
Figure 10:
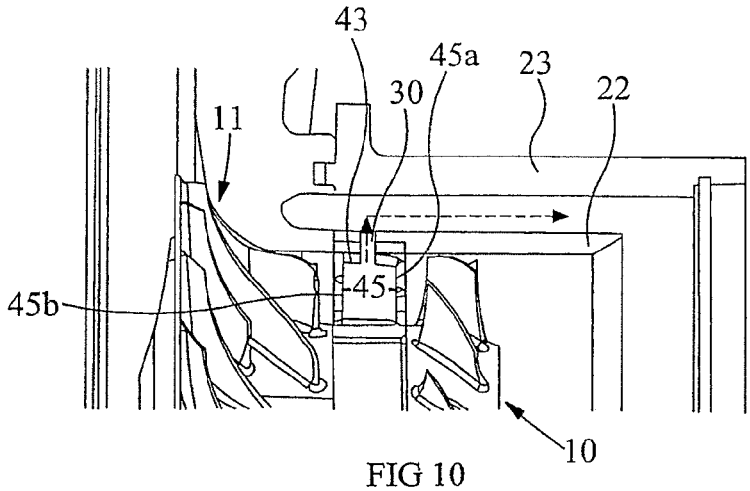
Figure 11:
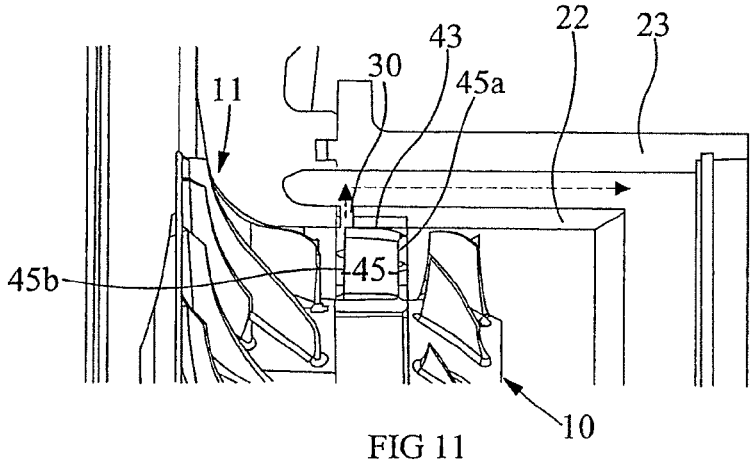

In the alternative configurations of FIGS. 9 to 11 the slot 30 is provided in the inner wall 22 somewhere along the axial extent of the stator 12. In practice, the slot 30 may be positioned such that any part of it overlaps any part of the outer edge 43 of the stator vanes 45. For example in FIG. 9, the slot starts at, or is immediately adjacent to, a radial plane that intersects the junction of the leading edge 45*a* and outer edge 43 of the vanes 45 of the stator 12, whereas in FIG. 10 it starts at what is substantially a mid-point between the leading and trailing edges 45*a*, 45*b* and in FIG. 11 it starts at, or is immediately adjacent to, a radial plane that intersects the junction between the outer and trailing edges 43, 45*b* of the vanes 45.

It is to be understood that the configuration of the impeller wheel hubs 39, 51 and the stator 12 described above in relation to FIG. 4 may be used in any of the compressor embodiments of FIGS. 6 to 11.

Turning now to FIGS. 12 to 15, the MWE flow passage 27 may be divided into separate portions 27*a*, 27*b* by a wall 65 so that the recirculating air is divided into two MWE flow paths. In the embodiment of FIG. 12, the recirculating air flow has a first path that starts at the annular slot 30 at or adjacent to the outer and leading edges 40 of the radial compressor impeller vanes 26 and is directed outwards by the slot 30 to the first portion 27*a* of the annular passage 27 along which it flows, as indicated by the dotted line. A second slot 70 is provided at the leading edge 45*a* of the stator vanes 45 and provides an exit for the first flow path such that the air flows radially inwards to the stator 12. A third slot 71 is provided at a trailing edge 53 of the vanes 50 axial compressor impeller wheel 10 and provides a starting point for the second path which passes outwards through slot 71 to the second portion 27*b* of the flow passage and along the rest of the flow passage 27 to the intake.

In the compressor embodiment of FIG. 13, the only difference over that shown in FIG. 12 is that second slot 70 is disposed at an axial position substantially mid-way between the leading and trailing edges 45*a*, 45*b* of the stator vanes 45, so that the distance the recirculating air flows in the first portion of the annular passage is shortened as illustrated by the dotted lines. In FIG. 14, the second slot 70 is even closer to the first slot 30 and coincides approximately with the trailing edge 45*b* of the stator vanes 45. FIG. 15 shows the same arrangement of FIG. 14 but the double-headed arrow illustrates that the axial position of the dividing wall 65 may be adjusted along the annular passage 27 so as to vary the volumes of the first and second portions 27*a*, 27*b* and particularly that part of the first portion 27*a* which is downstream (in the sense of the recirculating flow) of its exit provided by the second slot 70.

It is to be understood the second and third slots 70, 71 may be provided in any permutation of axial positions relative to the stator and axial impeller vanes 45, 50 respectively.

In the embodiments where there are two MWE flow paths there may be provided an additional adjustable flow path restriction or opening. In one arrangement the restriction is provided in a path that interconnects the two flow paths.

In an alternative arrangement the two MWE flow paths have a common exit and there is an additional restriction in only one of the paths e.g. the path that extends from the radial compressor impeller.

The restriction in each case may be variable and may be in the form of a valve. It may be controllable by the turbocharger control system such as, for example, the ECU of the internal combustion engine of a vehicle (see FIG. 1).

All of the compressor embodiments described above have the effect of widening the compressor map of the turbocharger to which it is fitted, thereby allowing the compressor to be used over a wider range of engine speeds. In particular the arrangements have the effect of moving the surge line to lower flow rates over the entire r.p.m. range of the compressor.

Each of the axial and radial compressor impellers 10, 11 may be separately manufactured and connected to the shaft 14 with the stator 12 in place and then balanced. They may also be separately balanced prior to fixing them to the shaft 14. In an alternative arrangement the two compressor impellers 10, 11 are manufactured as one piece and fitted to the shaft 14 in which case the stator 12, which would comprise several connectable parts, is then fitted over an interconnecting part between the impellers 10, 11.

Suitable materials for the various components will be evident to the person skilled in the art. For example, the inlet, stator and compressor housing may be manufactured from, for example, cast iron, aluminium alloy or stainless steel. In higher temperature applications other materials may be suitable such as, for example, titanium, composite materials and ceramics.

It will be appreciated that numerous modifications to the above described designs may be made without departing from the scope of the invention as defined in the appended claims. In particular, the relative lengths of the intake and inducer parts of the inlet may vary compared to those depicted. Moreover, additional compressor stages may be added as appropriate. In addition the MWE passage defined between the inner and outer walls may not necessarily be annular but may be partially annular or may comprise separate passages, spaced circumferentially around the inlet. Similarly the slots providing communication between the passage and the inner surface of the inner wall may be partially annular, discontinuous or may be replaced by a plurality of apertures spaced in a circumferential direction.

While the invention has been illustrated and described in detail in the drawings and foregoing description, the same is to be considered as illustrative and not restrictive in character, it being understood that only the preferred embodiments have been shown and described and that all changes and modifications that come within the scope of the inventions as defined in the claims are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A compressor comprising:

a housing defining a gas inlet and a gas outlet;

a radial impeller wheel having a plurality of vanes and mounted in the housing between said inlet and outlet, the wheel being rotatable about an axis;

the inlet comprising a substantially tubular wall extending away from the impeller wheel in an upstream direction and forming a gas intake, the inlet wall defining an inner surface at least a portion of which is located in close proximity to radially outer edges of the vanes of the radial impeller which sweep across said surface as the radial impeller wheel rotates about its axis;

an axial impeller wheel having a plurality of vanes and supported for rotation in said inlet upstream of the radial impeller wheel;

the axial and radial impeller wheels being mounted on a common shaft, the axial impeller wheel having an internal thread for connection to a corresponding thread on the shaft so as to retain the radial compressor impeller wheel in place;

wherein an axial stator with fixed vanes is provided between the axial and radial impeller wheels, the threaded axial impeller also serving to retain the stator in place.

2. A compressor comprising:

a housing defining a gas inlet and a gas outlet;

a radial impeller wheel having a plurality of vanes and mounted in the housing between said inlet and outlet, the wheel being rotatable about an axis;

the inlet comprising a substantially tubular wall extending away from the impeller wheel in an upstream direction and forming a gas intake, the inlet wall defining an inner surface at least a portion of which is located in close proximity to radially outer edges of the vanes of the radial impeller which sweep across said surface as the radial impeller wheel rotates about its axis;

an axial impeller wheel having a plurality of vanes and supported for rotation in said inlet upstream of the radial impeller wheel;

the axial and radial impeller wheels being mounted on a common shaft, the axial impeller wheel having an internal thread for connection to a corresponding thread on the shaft so as to retain the radial compressor impeller wheel in place;

wherein the thread is defined on an internal surface of a hub of the axial impeller wheel, the vanes extending from the hub; and wherein an axial stator with fixed vanes is provided between the axial and radial impeller wheels, the threaded axial impeller also serving to retain the stator in place.

* * * * *